United States Patent [19]

Hatta et al.

[11] 4,226,619

[45] Oct. 7, 1980

[54] AMORPHOUS ALLOY WITH HIGH MAGNETIC INDUCTION AT ROOM TEMPERATURE

[75] Inventors: Shinichiro Hatta, Tokyo, Japan; Takeshi Egami, Wayne; Charles D. Graham, Jr., Ardmore, both of Pa.

[73] Assignee: Electric Power Research Institute, Inc., Palo Alto, Calif.

[21] Appl. No.: 35,837

[22] Filed: May 4, 1979

[51] Int. Cl.[3] ..... C22C 38/12; C22C 38/00

[52] U.S. Cl. ..... 75/123 K; 75/123 B; 148/120; 148/121; 148/122

[58] Field of Search ..... 75/123 K, 123 B; 148/120, 121, 122

[56] References Cited

U.S. PATENT DOCUMENTS

| | | | |
|---|---|---|---|
| 3,856,513 | 12/1974 | Chen et al. | 75/122 |
| 4,036,638 | 7/1977 | Ray et al. | 75/123 B |
| 4,052,201 | 10/1977 | Polk et al. | 75/124 |
| 4,053,331 | 10/1977 | Graham, Jr. et al. | 148/120 |
| 4,067,732 | 1/1978 | Ray | 75/126 P |
| 4,144,058 | 3/1979 | Chen et al. | 75/170 |
| 4,152,144 | 5/1979 | Hasegawa et al. | 75/122 |
| 4,152,146 | 5/1979 | Freilich et al. | 75/123 B |

OTHER PUBLICATIONS

Yamauchi et al., "Amorphous . . . Fe-P-B Alloys . . . ", Jap. J. Appl. Phys. 10 (1971), 1730.

Egami et al., ". . . Magnetic Properties . . . Amorphous Alloys", Appl. Phys. Letts., 26 (1975), 128.

O'Handley et al., "Ferromagnetic Properties . . . ", Appl. Phys. Letts., 29 (1976), 330.

Hasegawa et al., "Magnetizations . . . $Fe_{80}B_{20}$ Glass", Appl. Phys. Letts., 29 (1976), 219.

*Primary Examiner*—L. Dewayne Rutledge
*Assistant Examiner*—Upendra Roy
*Attorney, Agent, or Firm*—Flehr, Hohbach, Test, Albritton & Herbert

[57] ABSTRACT

An amorphous alloy including iron, carbon and boron characterized by exceptional magnetic induction properties at room temperature, rendering it particularly suitable for use as the core of a power transformer. The alloy includes 83 to 90 atomic % iron, 2 to 13 atomic % carbon, and 4 to 15 atomic % boron, the total boron and carbon content ranging from 10 to 17 atomic %. If desired, up to 10% of the iron can be replaced by cobalt or nickel, while up to 2% of the carbon can be replaced by silicon or germanium.

13 Claims, No Drawings

AMORPHOUS ALLOY WITH HIGH MAGNETIC INDUCTION AT ROOM TEMPERATURE

BACKGROUND OF THE INVENTION

A wide variety of amorphous metal alloys have been suggested such as described in U.S. Pat. No. 3,856,513. Some of such alloys have been suggested for use in power transformers. Due to their intrinsic magnetic softness and high electrical resistivity, many of the transition metal-metalloid amorphous alloys have a.c. coercivity significantly less than conventional silicon-iron alloys. A significant reduction in the magnetic core losses of power transformers could result in major energy savings.

Perhaps the most serious disadvantage of amorphous alloys as replacements for conventional silicon-iron in transformer cores is the relatively low magnetic saturation induction. It is believed by the industry that formation of the amorphous alloys requires substantial quantities of non-magnetic glass-forming elements such as boron, phosphorus, carbon, or silicon, and this lowers the maximum attainable induction. The highest value of the room temperature flux density reported to date is 16.5 kGauss (kG) for an alloy of $Fe_{70}Co_{10}B_{20}$, wherein the subscript numbers refer to atomic percentages of the elements. However, the inclusion of 10% cobalt renders this alloy extremely costly for large-scale applications. In alloys containing no cobalt, the highest reported value is 16.1 kG for $Fe_{80}B_{20}$. This value is probably too low to permit large scale economic use in power transformers. A heat treatment under controlled stress is described in U.S. Pat. No. 4,053,333 to enhance the magnetic properties of amorphous metallic alloys.

SUMMARY OF THE INVENTION AND OBJECTS

It is an object of the invention to provide an alloy with high magnetic induction at room temperature, specifically one suitable for use as the magnetic core of a power transformer.

It is a specific object of the invention to provide a relatively low cost iron-boron-carbon alloy of exceptional flux density.

It is an additional object to provide such an alloy capable of increased flux density as a result of annealing.

In accordance with the foregoing objects, an alloy of high magnetic induction at room temperature is provided including 73 to 90 atomic % iron, 0 to 10 atomic % cobalt or nickel (the total iron, cobalt and nickel content ranging from 83 to 90 atomic %), and 8 to 17 atomic % boron and carbon. If desired, the alloy may include up to about 2 atomic % of silicon and germanium (the total carbon, silicon and germanium content ranging from 10 to 17 atomic %). The alloy preferably includes at least 90% of its volume in amorphous form. It is particularly suitable for use in an electrical transformer core. It may be annealed to improve its magnetic induction properties.

Further objects and features of the invention will be apparent from the following description of its preferred embodiments.

DETAILED DESCRIPTION OF THE PREFERRED EMBODIMENTS

The alloy of the present invention is essentially in the amorphous state. That is, it includes in excess of 90% of an amorphous glassy phase which may contain small microcrystals which do not substantially alter the magnetic properties attributed to such state. The general properties of amorphous metallic alloys are described in U.S. Pat. No. 4,053,333.

The alloy will first be described in terms of the three essential elements of iron, boron and carbon. Substitutions may be made for a portion of the iron or carbon as described below. Percentages will be expressed herein in terms of atomic percentages. As a convenient mode of expression, the compositions of the alloys herein will be referred to in certain instances by the use of subscript numbers following the elements which correspond to the atomic percentages.

The iron content of the alloy ranges from about 73 to 90%. A portion of the iron may be replaced with up to 10% of cobalt, nickel or a combination of them. The advantage of this substitution is that it increases the magnetic flux density at room temperature. In addition, significant amounts of nickel or cobalt increase the ease of formation of the amorphous state. However, nickel and cobalt are very costly in comparison to iron and are only used in the event that such increase is critical.

In the event that there is no substitution for the iron content, the range of the iron content is from 83 to 90%, preferably between 84 and 86% iron. Substitution of cobalt or nickel for iron within this range would occur on an atomic % for atomic % basis, i.e., an addition of cobalt or nickel leads to a decrease of iron.

The boron and carbon components of the system are complementary, i.e., any substantial increase in one of these elements leads to a decrease in the other. The preferred range for the total quantity of boron and carbon is about 8 to 17%. A small portion, up to about 2%, of the boron may be replaced by silicon or germanium or both. Assuming there is no substitution for boron or iron, the total composition includes 83 to 90 atomic % iron and 10 to 17 atomic % boron and carbon, with an increase in the former element resulting in a decrease in the latter group and vice versa.

The carbon content significantly improves the magnetic properties of the present alloy. For this purpose, the alloy suitably contains about 2 to 13% carbon and preferably about 5 to 7% carbon.

The boron and carbon content provides glass forming properties to the alloy. Boron and carbon are preferable present at 4 to 15% of the composition. A preferable range of the boron is from 7 to 10% to be reduced by the corresponding optional substitution of silicon or germanium.

The combination of the carbon and boron elements in the alloy provides a synergistic effect. In combination, this greatly increases the ease of formation of the amorphous state. In addition, the room temperature magnetization is significantly increased by the presence of the carbon in combination with the boron in comparison to the use of boron alone. This increase is believed to be due to the increase in the spin wave stiffness. When the carbon content is significantly above 7 atomic %, it becomes more difficult to prepare good amorphous alloys, and the saturation moment tends to decrease.

Tests of flux density in kGauss have been performed on the following alloy without annealing: $Fe_xC_yB_{100-x-y}$, wherein x equals 80, 84, 86 and 88. The carbon content in the formula was varied from 0 to 9. At x equals 80, the flux density value did not increase significantly with increasing carbon concentration and was relatively low with a maximum value of about 16.0 kG. The other alloys maximized the flux density values at above 16.5 kG with a carbon content varying from about 5 to about 8. The best value in this series about 17.4 kG for $Fe_{86}B_7C_7$.

Experiments were performed using a base alloy of $Fe_{84}B_{10}C_6$ in which iron was replaced with increasing amounts of nickel. The nickel content did not increase the room temperature induction properties of the product. However, nickel facilitates production and stability of the amorphous state and so may be of some value in that regard.

In contrast to nickel, replacement of iron by a small amount of cobalt significantly increases magnetization. For example, in a base alloy of $Fe_{86-z}Co_zB_8C_6$, z was varied from 0 to 12. The saturation magnetization was a maximum for $Fe_{77}Co_9C_6B_8$ yielding a magnetic induction of 18.4 kG. This exceptional value renders such alloy useful for small transformers or motors.

The simultaneous addition of both nickel and cobalt to the iron-boron-carbon system enhances the annealing effect as set forth below. However, the thermal stability tends to be degraded. The substitution of a portion of the boron by silicon improves the stability of this alloy system to a certain degree. The maximum value of magnetic induction obtained in the as-quenched state with inclusion of 1% cobalt is 16.9 kG for $Fe_{84}Ni_3Co_1B_7C_5$ and $Fe_{84}Ni_3Co_1B_5C_5Si_2$.

In general, the maximum flux densities of the iron-boron-carbon system unsubstituted with other elements are in the range of 16.5 to 17.4 kGauss, which is substantially higher than other amorphous alloys suggested as magnetic cores while being substantially less expensive. By way of example, a plot was made of $Fe_{86}B_{14-y}C_y$ in which carbon was varied from 0 to 10. The flux density increased from about 16.0 at 0% carbon to about 17.4 at about 5 to 7% carbon and thereafter decreased. Thus, there is an optimum carbon content in this 3-component system of about 5 to 7% to provide the maximum flux density.

It has been found that heat treatment of the foregoing alloys increases the room temperature magnetization in terms of flux density. This increase is believed to be due to the increasing spin wave stiffness upon annealing. The conditions of annealing are selected to provide a microstructure including mostly amorphous phase and a minimal amount of microcrystals. The temperature of annealing may vary over a wide range of about 150° C. to 350° C., with the time of annealing being significantly shorter at the higher end of the range than at the lower end. For most commercial applications, the preferred temperature is on the order of 230° C. to 270° C. At substantially lower temperatures, the annealing time may be prohibitively long for commercial application. For example, at a temperature of 150° C., annealing may require a month while at a temperature of 200° C., a week, and at a temperature of 300° C., 5–20 minutes. Temperatures substantially above 300° C. are preferably avoided as the sample may partially crystallize, leading to a degradation in the magnetic properties.

The improvement in annealing properties depends to a significant extent on the particular alloy to be treated. In general, annealing may increase the flux density from a value of say 17.0 to 17.4 or 17.4 to 17.8, a significant increase in terms of energy savings in reducing magnetic core losses in power transformers.

It has been found that heat treatment is preferably performed under stress to maximize the increase in magnetic properties. While this procedure has been described in U.S. Pat. No. 4,053,333, it is particularly effective for increasing the magnetic properties of the present alloys. The precise amount of stress may vary over a wide range, e.g., from 0.5 kg/mm$^2$ to 10 kg/mm$^2$ or more.

What is claimed is:

1. An alloy with a room temperature flux density in excess of 16.5 kGauss comprising 73 to 90 atomic % iron, 0 to 10 atomic % of an element selected from the group consisting of cobalt, nickel or a combination thereof, the total iron, cobalt and nickel content ranging from 83 to 90 atomic %, and 8 to 17 atomic % of boron and carbon.

2. The alloy of claim 1 including 0–2 atomic % of an element selected from the group consisting of silicon, germanium or a combination thereof, the total carbon, silicon, and germanium content ranging from 10 to 17 atomic %.

3. The alloy of claim 1 including 84 to 86 atomic % iron.

4. The alloy of claim 1 including 2 to 13 atomic % carbon.

5. The alloy of claim 1 including 4 to 15 atomic % boron.

6. The alloy of claim 1 including 5 to 7 atomic % carbon and 7 to 10 atomic % boron.

7. The alloy of claim 1 with a microstructure with at least 90% amorphous form.

8. The alloy of claim 1 in the form of an electrical transformer core.

9. An alloy consisting essentially of 84 to 86 atomic % iron, 5 to 7 atomic % carbon, and the remainder boron, at least 90% of said alloy being in amorphous form.

10. A method for forming an alloy including a microstructure of at least 90% amorphous form and with a room temperature flux density in excess of 16.5 kGauss, comprising the step of annealing an alloy comprising 73 to 90 atomic % iron, 0 to 10 atomic % of an element selected from the group consisting of cobalt, nickel, or a combination thereof, the total iron, cobalt and nickel content ranging from 83 to 90 atomic %, and 8 to 17 atomic % of boron and carbon, said annealing step being performed below the crystallization temperature of said alloy.

11. The method of claim 10 in which said annealing step is performed at a temperature from about 150° C. to 350° C.

12. The method of claim 10 in which said annealing step is performed at a temperature from about 230° C. to 270° C.

13. The method of claim 10 in which said annealing step is performed under tensile stress.

* * * * *